US007182160B2

(12) United States Patent
Boulet

(10) Patent No.: US 7,182,160 B2
(45) Date of Patent: Feb. 27, 2007

(54) DRILL STRING ELEMENT HAVING AT LEAST ONE BEARING ZONE, A DRILL STRING, AND A TOOL JOINT

(75) Inventor: Jean Boulet, Paris (FR)

(73) Assignee: S.M.F. International, Cosne-sur-Loire (FR)

( * ) Notice: Subject to any disclaimer, the term of this patent is extended or adjusted under 35 U.S.C. 154(b) by 267 days.

(21) Appl. No.: 10/777,768

(22) Filed: Feb. 13, 2004

(65) Prior Publication Data

US 2004/0195009 A1 Oct. 7, 2004

(30) Foreign Application Priority Data

Feb. 20, 2003 (FR) ..... 03 02096

(51) Int. Cl.
*E21B 17/18* (2006.01)

(52) U.S. Cl. ..... 175/320; 175/323; 175/325.3

(58) Field of Classification Search ..... 175/73–76, 175/230, 320, 323, 324, 325.1–325.5, 326
See application file for complete search history.

(56) References Cited

U.S. PATENT DOCUMENTS 4,540,055 A * 9/1985 Drummond et al. ..... 175/323
4,854,399 A * 8/1989 Zijsling ..... 175/61
5,040,620 A * 8/1991 Nunley ..... 175/61
6,223,840 B1 5/2001 Swietlik

FOREIGN PATENT DOCUMENTS

FR 2 760 783 A1 9/1998
FR 2 789 438 A1 8/2000
FR 2 824 104 A1 10/2002

* cited by examiner

*Primary Examiner*—Frank S. Tsay
(74) *Attorney, Agent, or Firm*—Sughrue Mion, PLLC

(57) ABSTRACT

The drill string element has at least one bearing zone for bearing against the wall of the borehole during drilling. The bearing zone comprises at least one bearing segment extending in the axial direction and having an outside surface that is cylindrical and of constant diameter greater than the diameter of any other portion of the surface of the element, and also having a guide zone that is circularly symmetrical about the axis of the drill string element. The bearing zone preferably also has a drilling fluid activation zone extending axially in a disposition adjacent to the bearing segment. The guide zone presents a radius of curvature not less than one-third the outside diameter of the bearing segment. The outside surface of the intermediate activation zone presents a meridian having a first meridian portion and a second meridian portion situated downstream from the first meridian portion, the meridian portions being inclined in opposite directions relative to the axis, sloping towards the axis and being connected together by a minimum-diameter portion of the bearing zone.

20 Claims, 7 Drawing Sheets

DRILL STRING ELEMENT HAVING AT LEAST ONE BEARING ZONE, A DRILL STRING, AND A TOOL JOINT

The invention relates to a drill string element comprising at least one bearing zone for bearing against the wall of a borehole.

BACKGROUND OF THE INVENTION

Drill strings are known that are used in the fields of prospecting for and of working oil deposits, which strings are constituted by rods and possibly other tubular elements that are assembled end to end depending on drilling requirements. To make the borehole, the end of the drill string has a drilling tool which is set into rotation about its longitudinal axis with a load being applied to the drill string along said axis.

The diameter of the drilling tool is significantly greater than the ordinary diameter of the rods in the drill string, thereby leaving an annular space, referred to as a "drilling annulus", around the drill string during drilling.

The drill string is made up of elements, and in particular of tubular drill rods assembled together end to end so that the assembled drill string presents an internal bore along its entire length. Drilling fluid such as a drilling mud is injected from the surface inside the drill string so that the drilling fluid flows down to the bottom end of the drill string, to the drilling tool, where it is injected into the bottom of the borehole. The drilling fluid serves to lubricate the drilling tool and to sweep the bottom of the hole so as to evacuate the debris produced by the drilling tool together with the drilling fluid which flows up in the drilling annulus from the bottom of the hole to the surface.

Because of the forces involved during drilling, the drill string becomes deformed inside the borehole, such that certain portions of the drill string can come into contact with and rub against the wall of the borehole. The level of friction torque can then become very high during drilling. In particular, for deflected boreholes, i.e. boreholes in which azimuth direction or inclination relative to the vertical can be varied during drilling, friction torque due to rotation of the drill string while drilling deflected boreholes with a large offset can reach very high levels that can damage the equipment used or make the drilling target unattainable. In order to avoid or limit contact between certain portions of the drill string and the wall of the borehole, in particular in portions of the borehole that slope little relative to the horizontal, and in order to avoid or limit the friction and wear that can result therefrom, the drill string is built up using drill string elements that have bearing zones of diameter greater than the nominal diameter of the rods in the drill string, and generally greater than the diameter of all other portions of the drill string elements. These maximum-diameter bearing zones come into contact with the wall of the borehole in the low portions thereof (i.e. portions situated below the practically horizontal axis of the hole) at zones that are spaced apart in the axial longitudinal direction of the drill string, so that isolated points of contact between the drill string and the borehole enable the friction torque on the drill string to be diminished.

Such maximum-diameter bearing zones can be provided, for example, on elements of the drill string such as tool joints, drill collars, or drill rods presenting profiles in a very wide variety of shapes. In particular, such bearing zones can be provided as described in French patent application FR-97/03207 in a portion of a drill rod adjacent to a zone for cleaning the borehole and for activating drilling fluid circulation, where the drill rod presents helical grooves of asymmetrical section. That enables those portions of the drill rod that include the drilling fluid activation grooves to be set into rotation inside the borehole without running the risk of coming into contact with the wall of the borehole.

In order to further improve the performance of bearing zones in terms of reducing friction at said bearing zones, French patent application FR-99/01391 proposes providing helical grooves in the outside surfaces of the bearing zones, the grooves being of cross-section that decreases in the axial direction and in the flow direction of the drilling fluid inside the drilling annulus. In this way, the fluid which flows in the axial direction inside the drilling annulus is channeled by the grooves of decreasing section in the zones where the string bears against the wall of the borehole, thereby producing flows in a radial direction around the outside surface of the bearing zone. This produces a hydrodynamic bearing effect at the bearing zone and decreases friction.

Nevertheless, machining bearing zones to obtain helical grooves of decreasing section is an operation that can be difficult and expensive. In addition, covering the bearing zones in a layer of wear-resistant material is made more difficult.

It is clearly preferable, for questions of cost and ease of manufacture, to make the bearing zones continuous and cylindrical in shape, being covered in a layer that provides protection against wear.

OBJECTS AND SUMMARY OF THE INVENTION

The object of the invention is thus to propose a drill string element for drilling a borehole with drilling fluid flowing in an annulus between the drill string and a wall of the borehole in a flow direction along a longitudinal axis of the drill string going from a bottom end of the borehole towards the surface, the drill string element including at least one bearing zone for bearing against the wall of the borehole during drilling that can be made in a manner that is relatively simple and inexpensive while nevertheless reducing friction at the bearing zone.

For this purpose, the bearing zone of the drill string element comprises at least one bearing segment whose outside surface is cylindrical and of substantially constant outside diameter greater than the diameter of any other portion of the drill string element, together with a guide zone of convex curved shape tangential to the bearing zone and presenting a meridian having a radius of curvature at all points that is not less than one-third the diameter of the bearing segment, the meridian extending axially in a disposition adjacent to the bearing segment of cylindrical surface.

In a preferred embodiment, the element further comprises, in a disposition adjacent to the bearing segment, a drilling fluid activation zone of circular symmetry about the axis of the drill string, having an outside surface presenting a meridian with a first portion and a second portion situated downstream from the first portion in the drilling fluid flow direction, said portions being generally inclined in opposite directions relative to the axial direction of the drill string, sloping towards the axis of the drill string and connected together by a meridian line of a minimum-diameter central section of the bearing zone.

In more particular embodiments of the invention, taken separately or in combination:

upstream from at least one bearing segment, the drill string element presents a drilling fluid guide zone tangential to the bearing segment whose convex outside surface presents a continuous curved meridian, in particular a circular meridian, having a radius of curvature that is not less than one-third the diameter of the bearing segments;

upstream and downstream from the bearing zone the outside surface of the drill string element comprises portions of generally convex shape having a radius of curvature not less than one-third the diameter of at least one bearing segment;

at least one of the convex surface portions of the outside surface of the drill string element disposed upstream and downstream from the bearing zone includes grooves formed therein following helical dispositions around the axis of the drill string element;

at least one segment of the bearing zone is of a length that is less than or equal to 80 millimeters (mm);

the element further comprises, in a disposition adjacent to the bearing segment, a drilling fluid activation zone of circular symmetry about the axis of the drill string, having an outside surface presenting a meridian with a first portion and a second portion situated downstream from the first portion in the drilling fluid flow direction, said portions being generally inclined in opposite directions relative to the axial direction of the drill string, sloping towards the axis of the drill string and connected together by a meridian line of a minimum-diameter central section of the bearing zone;

the bearing zone of the drill string element has a first bearing zone and a second bearing zone disposed downstream from the first bearing zone in the direction of drilling fluid flow in the annulus, and the drilling fluid activation zone extends axially between the first bearing segment and the second bearing segment;

the first portion of the meridian of the activation zone of the bearing zone presents a general direction making a first angle $\alpha$ with the axial direction of the drill string that is less than a second angle $\beta$ made between the general direction of the second portion of the meridian of the outside surface of the activation zone and the axial direction of the drill string;

the drilling fluid guide zone comprises a portion downstream from the activation zone having as its meridian the second portion of the meridian of the activation zone;

the outside surface of the drill string element has grooves machined therein, in the activation zone of the bearing zone in dispositions that are generally helical about the axis of the drill string element;

the outside surface of the central section of minimum diameter of the bearing zone includes cavities distributed around its periphery, preferably being machined to be undercut, so as to obtain a scoop effect for stirring the drilling fluid in the activation zone during rotation of the drill string; and the outside surface of at least one segment of the bearing zone is covered by a covering of hardness that is much greater than the hardness of the base metal of the drill string element, the covering extending between first and second lines of contact between the outside surface of the bearing segment and one of the guide zone and of a portion of the activation zone tangential to the segment.

The invention also relates to an element constituting a drill rod having upstream and downstream end coupling portions, and between the coupling portions at least one bearing zone having at least one bearing segment and at least a guide zone and an activation zone adjacent to the bearing segment.

The drill rod may include:

first and second bearing zones in dispositions that are adjacent respectively to its upstream end junction portion and its downstream end junction portion and at least one bearing zone between the bearing zones respectively adjacent to the upstream end junction portion and to the downstream end junction portion, spaced apart in the axial direction of the drill rod away from the end junction portions;

in a disposition adjacent to and upstream from the bearing zone, a cleaning zone in which the outside surface of the drill string element has cavities or grooves, preferably in helical dispositions, and including undercut portions;

in its outside surface, a deflection surface at one end of the cleaning zone adjacent to the bearing zone of the drill rod; and downstream from the bearing zone, a groove about the axis of the drill string element and including a deflection surface inclined relative to the axis of the drill string element towards the wall of the borehole, at an axial end of the groove remote from an adjacent end of the bearing zone.

The invention also provides a drill string element having upstream and downstream end junction portions or tool joints, wherein each tool joint includes at least one bearing zone having at least a bearing segment and a drilling fluid stirring zone adjacent to the bearing segment.

The drill string element may include helical grooves machined in the outside surface of the tool joint, preferably in helical dispositions with undercut portions, in at least one of the intermediate activation zone of the bearing zone and a zone adjacent to the bearing zone and upstream from the bearing zone.

BRIEF DESCRIPTION OF THE DRAWINGS

In order to make the invention well understood, there follows a description by way of example and with reference to the accompanying figures of a plurality of embodiments of a drill string element of the invention and its use in a drill string for implementing various functions.

MORE DETAILED DESCRIPTION

Figure 1:
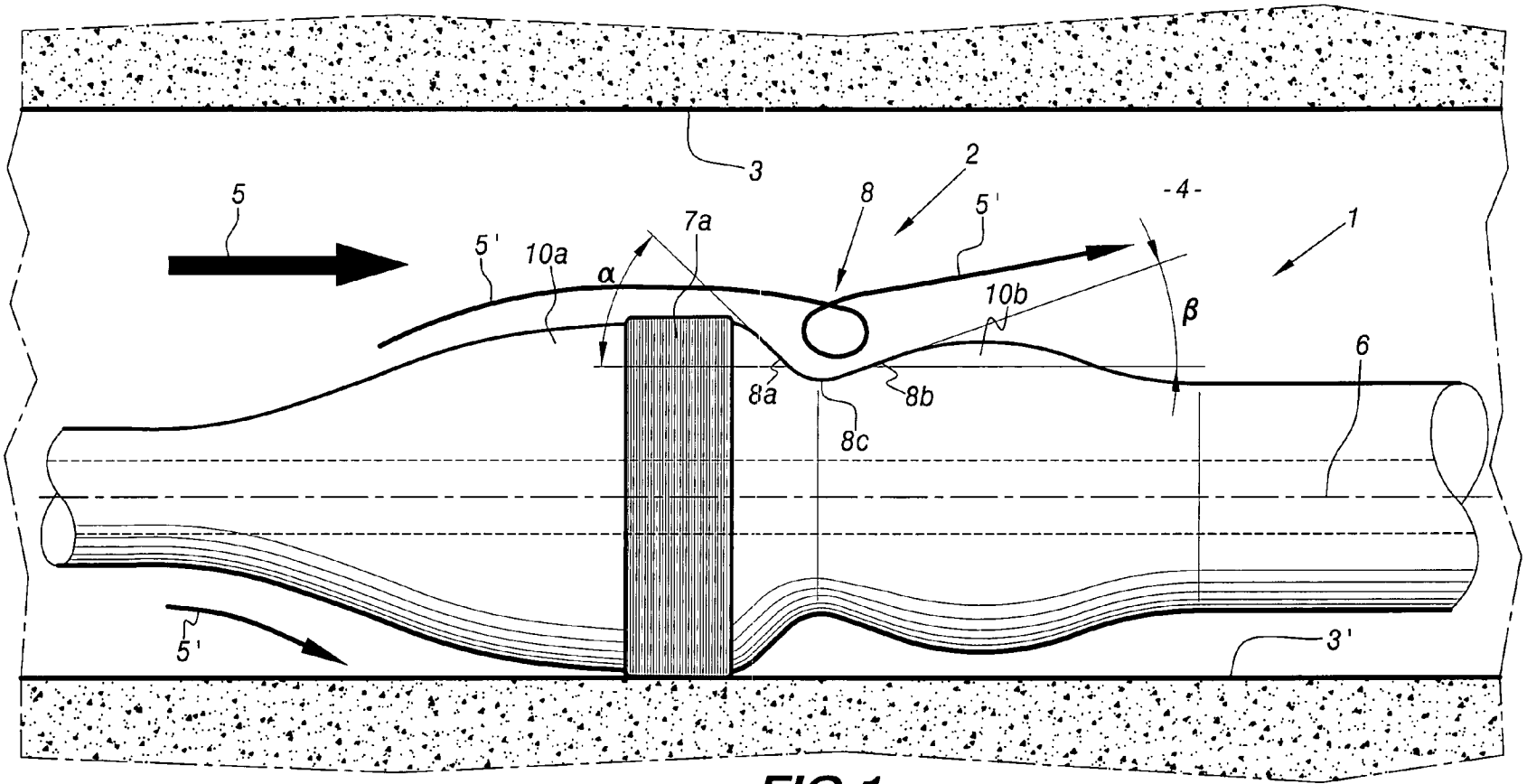
FIG. 1 is a side elevation of a segment of a drill string element of the invention in a first embodiment.

FIG. 1 shows a segment of a drill string element 1 of the invention, at a bearing zone 2 of a shape that is characteristic of a drill string element in accordance with the invention.

The drill string element 1 which may be a drill rod having bearing zones such as 2 is shown in its in-service position in a portion of a borehole 3 that is horizontal or only slightly inclined relative to the horizontal and that includes a wall 3'. Between the drill string elements and the wall 3' of the borehole 3, there is an annular space 4 referred to as an "annulus", in which there flows a drilling fluid in the direction of arrow 5, which drilling fluid is a drilling mud, for example. The drilling fluid flows in the axial direction of the drill string, i.e. parallel to the axis 6 of the drill string element and in a direction going from the bottom of the borehole 3 towards the surface.

The drill string element 1 rests via its bearing zone 2 against the wall 3' of the borehole, in the substantially horizontal bottom portion of the borehole 3.

The drill string element is of tubular shape and has a central bore 6 in which the drilling fluid flows in the axial direction, going from the surface towards the bottom of the borehole. While building up the drill string by assembling tubular elements end to end, a tubular duct is made enabling drilling fluid to be taken from the surface and brought to the bottom of the hole, the drilling fluid then serving to sweep the bottom of the hole and then flow upwards in the annulus 4, entraining the debris formed by the drilling tool.

The bearing zone 2 of the drill string element 1 shown in FIG. 1 presents an outside surface that is circularly symmetrical about the axis 6 and having a meridian (visible in FIG. 1) constituting the outline of the bearing zone that presents a characteristic shape.

The bearing zone 2 presents a segment 7*a* of continuous cylindrical shape having a circular section constituting the upstream portion of the bearing zone 2 in the flow direction 5 of the drilling fluid in the annulus 4 which has meridian lines that are substantially rectilinear. Upstream from the bearing segment 7*a* there is a drilling fluid guide zone 10*a*, and downstream therefrom there is an activation zone 8. The outside surface of the guide zone 10*a* presents a convex curved shape modifying the axial flow of the drilling fluid so as to provide a hydrodynamic bearing effect at the bearing segment 7*a*.

The outside surface of the activation zone 8 which is circularly symmetrical about the axis 6 of the drill string and of the element 1 presents a concave shape having a meridian line constituted by two portions, respectively an upstream portion 8*a* and a downstream portion 8*b* which meet at a line 8*c* that is more or less parallel to the axis 6 and constitutes the meridian of a central portion of the bearing zone 2 of the element 1 that is of minimum diameter. The diameter of the central portion of the bearing zone 2 is, in particular, significantly smaller than the diameter of the cylindrical segment 7*a*. The two portions 8*a* and 8*b* of the meridian line of the outside surface of the stirring zone 8 have directions that slope in opposite directions relative to the axis 6 of the drill string element 1 in such a manner that these portions of the meridian line are directed towards the axis 6 of the drill string element 1, going from the upstream and downstream ends of the bearing zone, respectively.

In the embodiment shown in FIG. 1, the two portions 8*a* and 8*b* of the meridian line of the outside surface of the stirring zone 8 are curved, and the tangents to these curved lines slope towards the axis 6 in opposite directions.

The convex curved guide zone 10*a* situated immediately upstream from the bearing segment 7*a* may be generally in the form of part of a torus. The meridian of the guide zone 10*a* is then a circle of radius R equal to not less than one-third the outside diameter of the bearing segment 7*a*.

Together the convex curved shape having a large radius of curvature of the guide zone 10 and the rotation of the drill string enable the flow of drilling fluid to be modified upstream from the bearing segment 7*a* (as represented by arrow 5') so as to obtain fluid streams that produce a hydrodynamic bearing effect between the bearing surface of the bearing segment 7*a* and the wall 3' of the hole 3 (at the bottom thereof). In a portion of the drill string element downstream from the bearing zone 7*a*, a second convex curved guide zone 10*b* can be provided. Under such circumstances, the meridian of the second guide zone 10*b* may comprise the second portion 8*b* of the meridian of the activation zone 8 which presents the shape of a portion of a circle having a large radius of curvature.

In general, the first portion 8*a* of the meridian of the activation zone 8 presents a general angle of inclination relative to the axis 6 of the drill string element that is much greater than the general angle of inclination of the second portion 8*b* of the meridian. The general angle of inclination of the portions 8*a* and 8*b* of the meridian in the activation zone 8 is defined by respective angles $\alpha$ and $\beta$ between the tangent to the meridian portion (at a midpoint along the meridian portion) and the axis 6 of the drill string element.

In certain cases, the bearing zone may comprise solely the bearing segment and at least one convex guide zone of large radius of curvature in a position adjacent to the bearing segment. The radius of curvature R (which is constant for a toroidal guide zone having a circular meridian) is not less than one-third the diameter of tile bearing segment and is preferably equal to or greater than half the diameter of the bearing segment.

Figure 2:
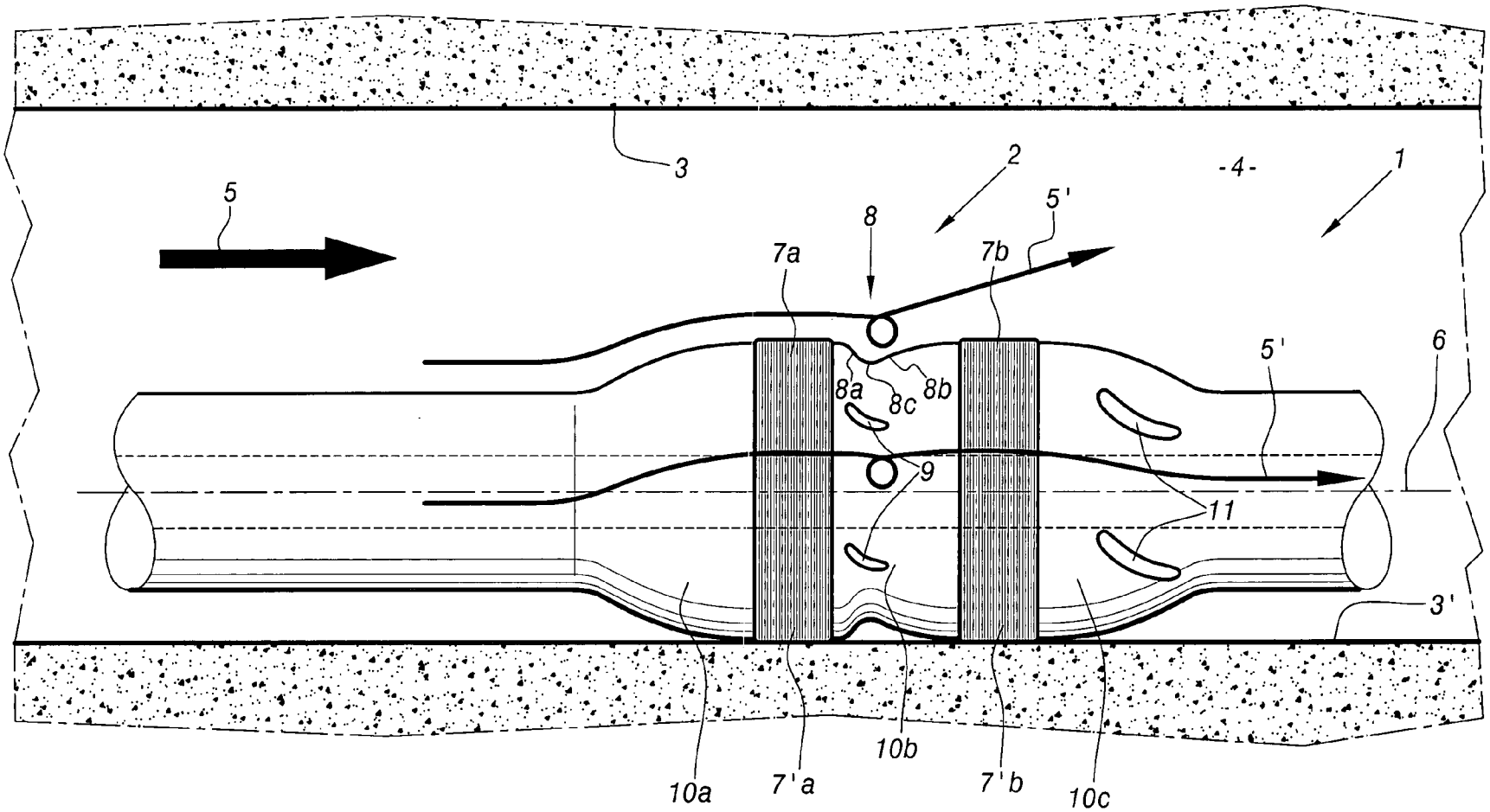
FIG. 2 is a fragmentary side elevation view of the bearing zone of a drill string element of the invention in a second embodiment.

In FIG. 2, there is shown a second embodiment of a drill string element in accordance with the invention.

The bearing zone 2 of the drill string element in the second embodiment comprises two bearing zones: an upstream bearing zone 7*a* and a downstream bearing zone 7*b*. The activation zone 8 is disposed between the two bearing segments and presents a shape analogous to the activation zone 8 of the drill string element in the first embodiment as shown in FIG. 1. The first portion 8*a* and the second portion 8*b* of the meridian of the activation zone are curved and meet at a meridian portion 8*c* constituting the central section of minimum diameter of the activation zone 8.

The second portion 8*b* of the meridian of the activation zone presents a curved shape, e.g. in the form of a circle having a large radius of curvature. The downstream portion of the activation zone thus constitutes a guide zone 10*b* of convex curvature encouraging a hydrodynamic bearing effect at the downstream bearing zone 7*b*.

As in the first embodiment, a guide zone 10*a* having a convex curve of large radius of curvature is provided immediately upstream from the upstream bearing segment 7*a*.

The guide zones 10*a* and 10*b* upstream from the bearing zones 7*a* and 7*b* respectively serve to guide the fluid so as to produce a hydrodynamic bearing effect at the first and second bearing segments 7*a* and 7*b*.

The respective lengths in the axial direction of the upstream and downstream segments 7*a* and 7*b* and of the intermediate zone 8 of the bearing zone 2 can be selected in such a manner as to ensure good contact for the bearing zone 2 against the wall 3' of the borehole 3, while limiting the friction of the element 1 in the bearing zone to a low level. The length of the intermediate activation zone 8 depends on the desired hydrodynamic effect which is obtained by the shape of the concave profile of the outside surface of the activation zone 8.

In all cases, the bearing zone 2 is of a length in the axial direction 6 of the drill string that is short, the length of the bearing zone 2 being equal, for example, to the length of a conventional bearing zone in the form of a single, generally cylindrical portion that is generally covered in a layer of hard material for improving the ability of the bearing zones to withstand wear. In a drill string element of the invention, the outside surface of the two bearing segments, respectively the upstream and the downstream segments 7*a* and 7*b* of the bearing zone can likewise be covered in respective layers of hard material 7'*a* and 7'*b*. The material covering the outside surfaces of the bearing segments 7*a* and 7*b* presents hardness that is much greater than the hardness of the material (e.g. steel) constituting the base material of the drill string element. The covering extends axially between the lines of contact of the guide zone 10*a* (or 10*b*) and the portion 8*a* (or 8*b*) of the activation zone, with the outside surface of the bearing segments which are mutually tangential. Thus, the bearing segment are not only the portions of the drill string element having the largest diameter, but they are also the portions of the drill string element having the greatest hardness.

The two zones 10*a* and 10*c* of generally convex shape that are disposed respectively immediately upstream and immediately downstream from the upstream and the downstream bearing segments 7*a* and 7*b* are themselves generally toroidal in shape having a radius of curvature which is greater at all points than one-third the outside diameter of the bearing segment 7*a* or 7*b*.

The nominal outside diameter of the drill string element 1 in its portions disposed on ether side of the bearing zone 2 and the zones 10*a* and 10*b* generally presents the minimum diameter of the drill string element 1.

In addition, in the embodiment shown in FIG. 2, grooves 9 are machined into the concave outside surface of the zone 8 so as to encourage stirring and flow of the drilling fluid in the activation zone 8.

The grooves 9 present respective meridian lines disposed substantially along a helix having the axis 6 of the drill string element 1 as the axis of the helix. The helical grooves 9 may advantageously be machined with an undercut so as to improve stirring of the fluid during rotation of the element 1.

The two zones 10*a* and 10*c* of the drill string element 1 may also have grooves 11 extending along helical lines and machined therein, possibly also having an undercut shape.

Figure 3:
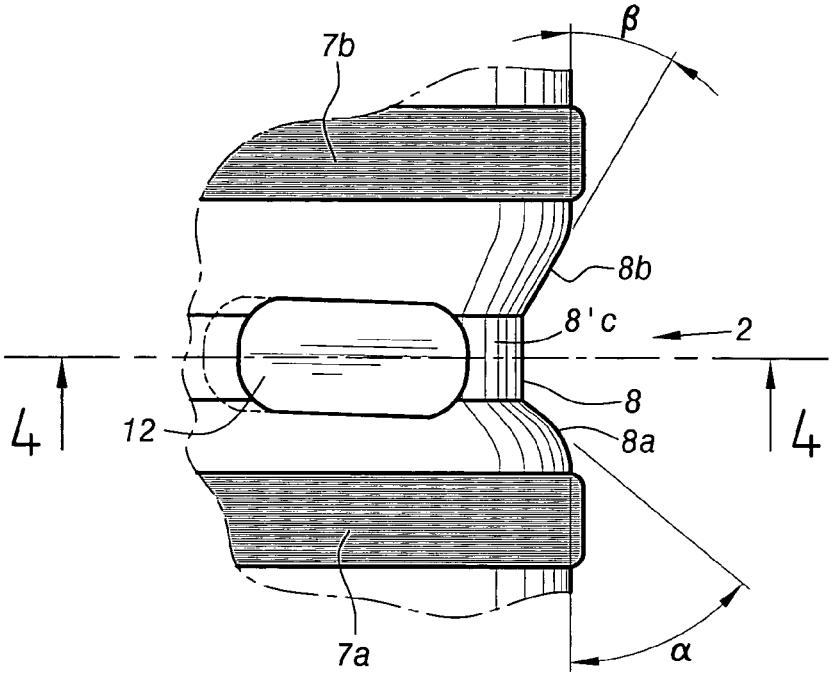
FIG. 3 is a fragmentary side view of the bearing zone of an element in a variant of the second embodiment.
Figure 4:
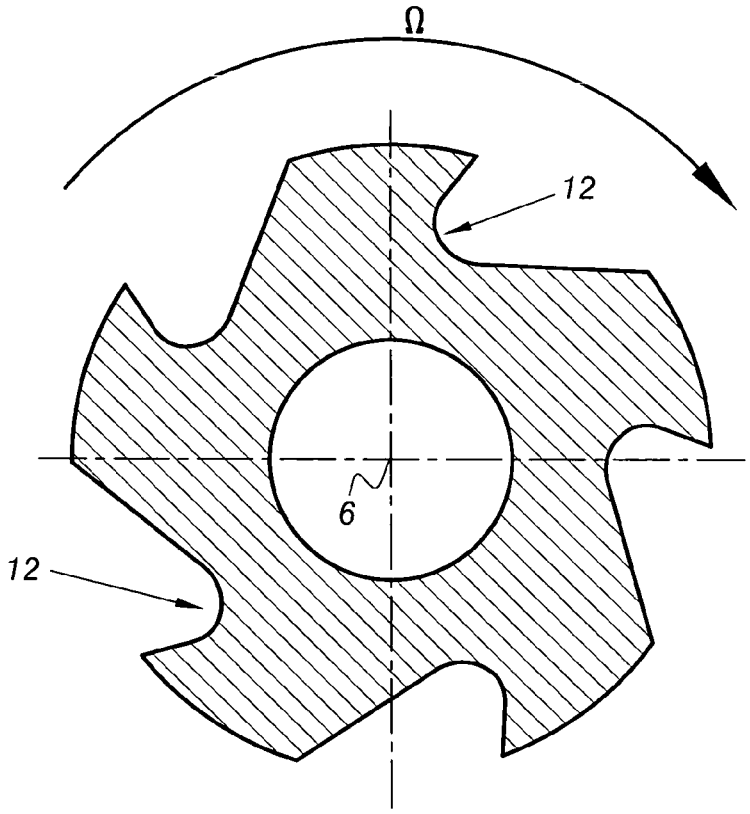
FIG. 4 is a cross-section view on 4—4 of FIG. 3.

FIGS. 3 and 4 show a variant embodiment of a bearing zone 2 of a drill string element in accordance with the invention.

The upstream and downstream segments 7*a* and 7*b* of the bearing zone 2 are cylindrical in shape and covered in wear material, being identical to the upstream and downstream segments of the bearing zone shown in FIG. 2.

The intermediate activation zone 8 between the upstream and downstream segments 7*a* and 7*b* of the bearing zone 2 presents an outside surface of a shape that is different from the shape of the outside surface of the intermediate zone 8 shown in FIG. 1.

The upstream and downstream portions 8*a* and 8*b* of the meridian of the outside surface of the activation zone 8 are rectilinear and inclined in opposite directions towards the axis of the drill string element. These upstream and downstream portions of the meridian joint the rectilinear meridian 8'*c* extending substantially parallel to the axis 6 of the drill string element in a minimum-diameter central section of the bearing zone.

In the central section 8'*c* of the meridian of the bearing zone, cavities 12 are machined each having an undercut end, e.g. five cavities 12 can be machined around the periphery of the segment 8' of the bearing zone in such a manner that the section of the minimum-diameter central segment of the bearing zone presents, in cross-section, the shape shown in FIG. 4. A circular arrow Ω shows the direction of rotation of the drill string inside the borehole, thus showing that the cavities 12 with respective undercut portions have a scoop effect inside the annulus in which the drilling fluid flows. This produces very good stirring of the drilling fluid in the activation zone 8 of the bearing zone 2.

In general, the profiles of the bearing zones 2 of the elements shown in FIGS. 1, 2, and 3 serve to obtain a flow of the drilling fluid in the bearing zone that gives rise to hydrodynamic bearing effects in rotation and to a reduction of friction in the axial direction.

As represented by arrows 5', in particular in FIG. 2, the streams of drilling fluid in the annulus 4 of the borehole 3 are guided upstream from the bearing zone 2 by the convex outside surface of the zone 10*a* which serves to deflect the drilling fluid towards the wall 3' of the hole 3. The drilling fluid reaching the activation zone 8 is subjected to intense stirring due to being put into a turbulent flow along the first portion of the activation zone whose outside surface is generated by the upstream meridian portion 8*a* which slopes steeply relative to the axis 6. The drilling fluid flowing turbulently in the enlarged portion of the drilling annulus in register with the minimum-diameter segment 8'*c* of the bearing zone ensures good stirring and good cleaning of the surface 3' of the borehole. The drilling fluid streams are then deflected by the portion 8*b* of the activation zone meridian that is directed towards the wall of the borehole, thereby generating streams that entrain cuttings and encourage the hydrodynamic bearing effect at the downstream segment 7*b* of the bearing zone.

In general, the meridian 8*a* of the upstream portion of the outside surface of the activation zone 8 slopes relative to the axis 6 of the drill string much more steeply than does the meridian 8*b* of the downstream portion. FIG. 2 shows respective angles α and β for the meridian portions 8*a* and 8*b* of the outside surface of the activation zone 8 relative to the axis 6. In general, the activation zone 8 is asymmetrical, which means the following inequality applies:

$$\alpha > \beta$$

Downstream from the bearing zone, the drilling fluid is guided in the annulus by the convex surface 10*c*.

Figure 5:
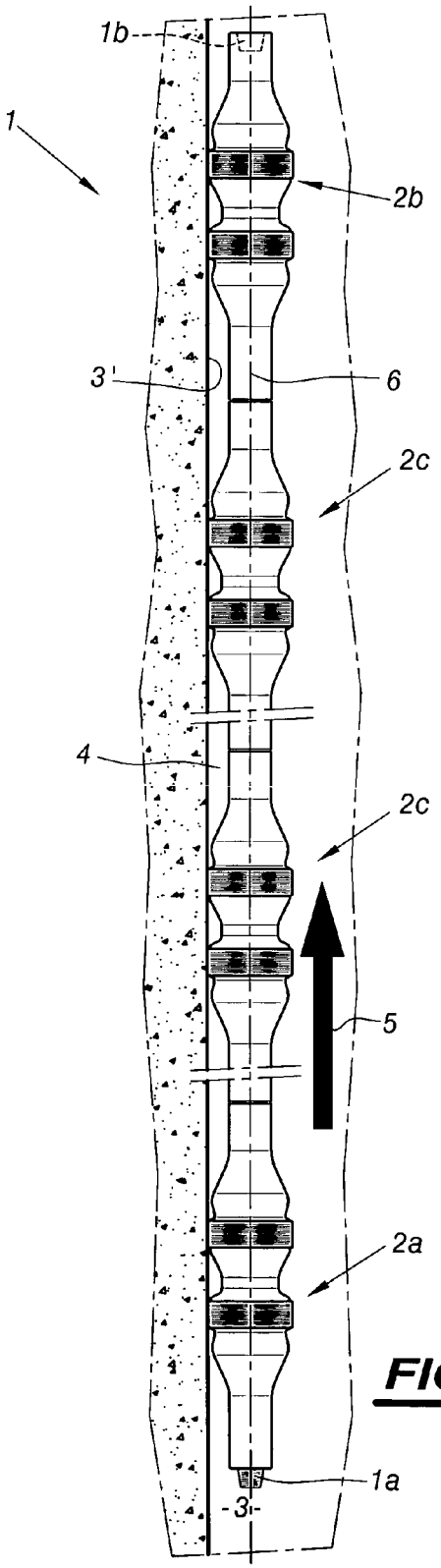
FIG. 5 is a side elevation view of a drill rod made in accordance with the invention and constituting a first embodiment.

FIG. 5 shows a drill string element 1 of the invention constituted by a drill rod having two end portions 1*a* and 1*b* for screw connection with other rods, a first bearing zone of the invention 2*a* close to the upstream junction portion la, a second bearing zone of the invention 2*b* close to the downstream junction portion 1*b*, and a plurality of intermediate bearing zones 2*c* of the invention spaced apart from one another along the axial direction 6 of the drill rod 1. The drill rod 1 may have, for example, two intermediate bearing zones 2*c* between its coupling end zones;

The profile of the drill rod 1 shown in FIG. 5 enables the rod to bear effectively against the wall 3' of the borehole 3 with reduced levels of friction and wear at the upstream and downstream segments of the bearing zones in contact with the wall 3' of the borehole 3, and also enables an effect to be obtained of activating flow of the drilling debris.

Figure 6:
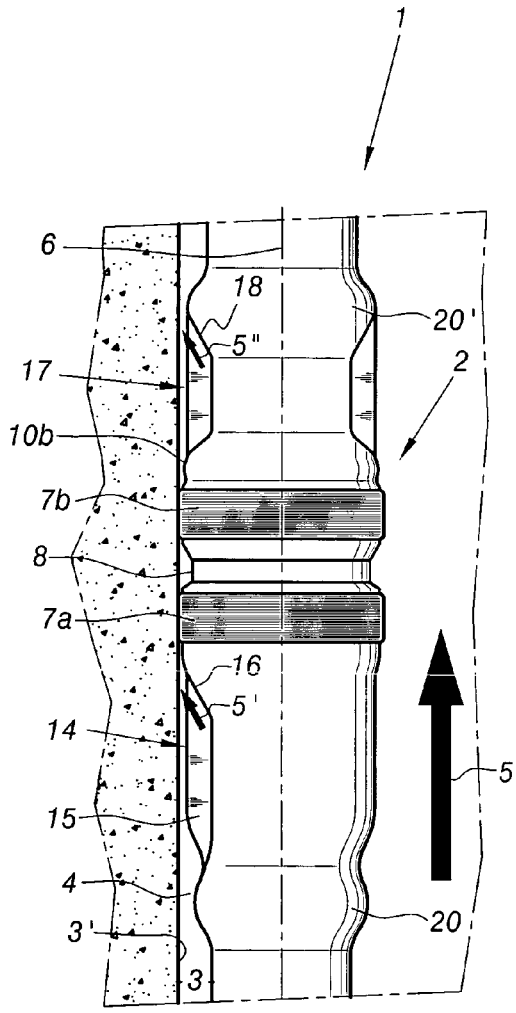
FIG. 6 is an elevation view of a drill rod made in accordance with the invention and constituting a second embodiment, including a zone for cleaning the borehole.

In FIG. 6, there can be seen a drill string element 1 constituted by a drill rod comprising a bearing zone 2 as described above and characteristic of drill string elements of the invention having in particular an upstream segment and a downstream segment respectively referenced 7*a* and 7*b* for bearing against the wall 3' of the borehole, and an intermediate zone 8 between the bearing zone segments 7*a* and 7*b* and serving to activate the drilling fluid and produce a hydrodynamic bearing effect at the upstream and downstream bearing segments 7*a* and 7*b* of the bearing zone 2.

In addition, the drill rod includes, upstream from the bearing zone 2, a borehole cleaning zone 14 in which the outside surface of the drill rod includes cavities or grooves 15 disposed generally helically about the axis of the drill rod and presenting, in a cross-section plane of the rod perpendicular to its axis 6, a hollow section including an undercut portion. For example, the cross-section of the cleaning zone 14 of the drill rod may be of a shape that is analogous to the section of the central portion of the activation zone 8 of a bearing zone of the invention as shown in FIG. 4. This produces a scoop effect during rotation of the drill rod, thereby enabling the wall 3' of the borehole to be cleaned. The helical disposition of the cavities 15 also improves entrainment of the drilling fluid and the cuttings in the general flow direction of the drilling fluid.

Each of the grooves or cavities 15 in the outside surface of the cleaning zone 14 includes, at its downstream end (in the drilling fluid flow direction), a deflector surface 16 inclined relative to the axis 6 of the drill rod so as to be directed towards the wall 3' of the drill hole in the drilling fluid flow direction. The drilling fluid flowing generally in the direction of arrow 5 inside the annulus 4 of the borehole is expelled from the outlet of the cleaning zone 15 towards the wall 3' of the borehole, as shown by arrow 5'. This improves the hydrodynamic bearing effect at the upstream bearing segment 7*a* of the bearing zone 2 of the drill rod.

Downstream from the bearing zone 2, the outside surface of the drill rod has a groove 17 defining a zone 10*b* of convex shape situated downstream from the bearing zone and presenting a radius of curvature that is longer than the nominal diameter of the drill rod 1. The groove 17 is defined at its downstream end by a deflector surface 18 directed towards the wall 3' of the borehole, thereby providing effective sweeping of the wall of the borehole by the drilling fluid at the downstream end of the drill rod (as represented by arrow 5") and putting the drilling fluid back into circulation downstream from the bearing zone 2.

Advantageously, the drill rod also includes two annular projections 20 and 20' of substantially toroidal shape disposed respectively upstream from the cleaning zone 14 and downstream from the deflection surface 18, thus enabling the central portion of the drill rod including in particular the cleaning zones 14 and the bearing zones 2 to be connected to the ordinary portion of the drill rod which is cylindrical in shape and circular in section.

Figure 7A:
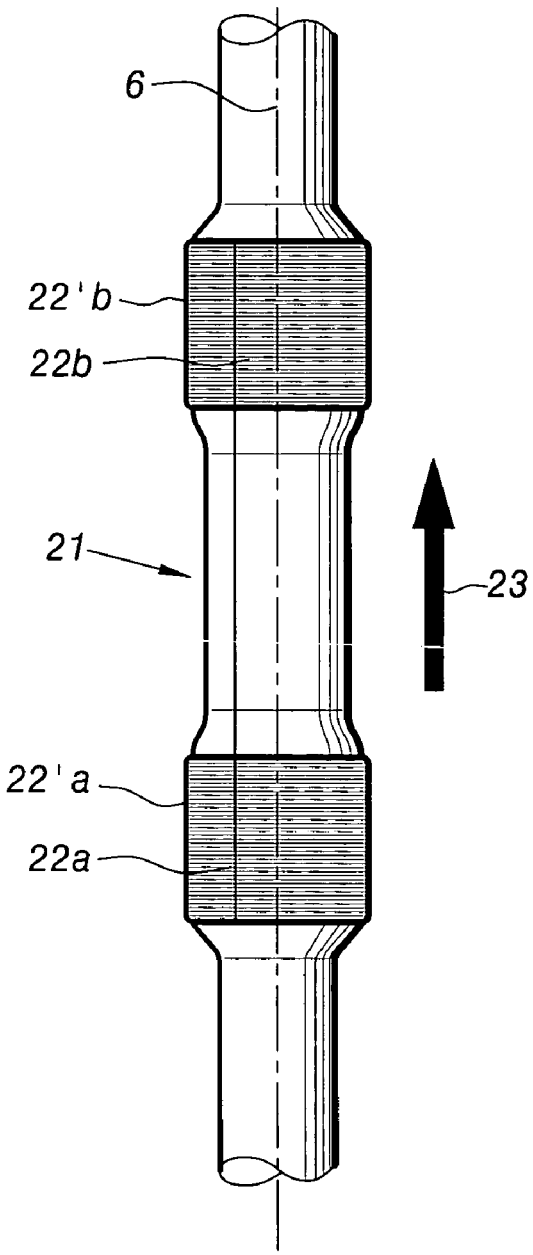
FIGS. 7A and 7B are comparative side views of drill string elements having bearing zones made respectively in accordance with the prior art and in accordance with the invention.
Figure 7B:
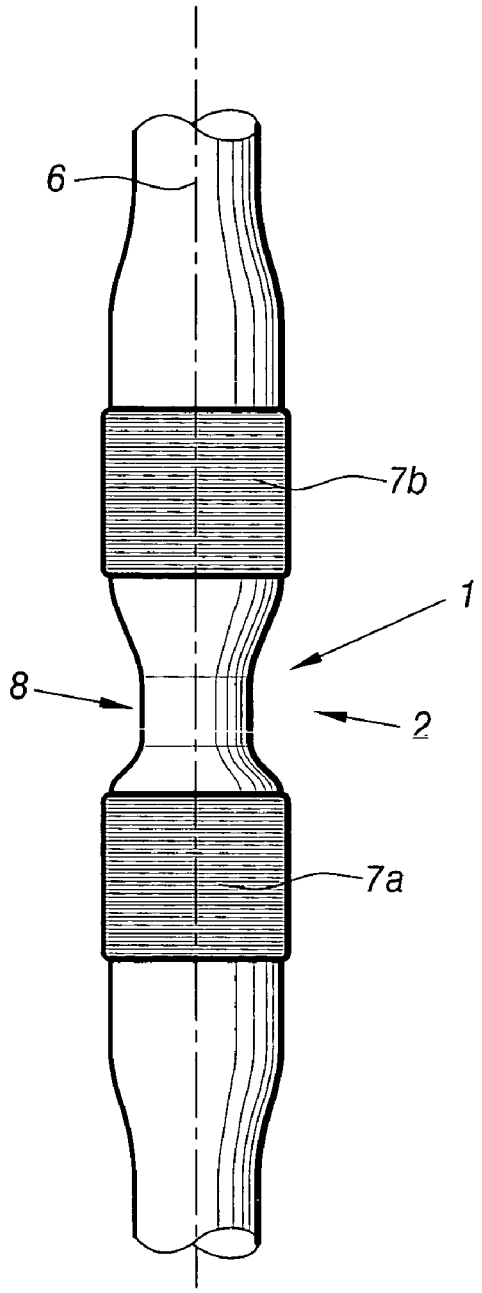

FIGS. 7A and 7B show respectively a prior art drill string element 21 and a drill string element 1 of the invention, both having a central zone in which bearing portions are provided enabling the drill rod to bear against a borehole wall.

The prior art drill rod 21 has a central portion presenting an upstream bearing zone 2*a* and a downstream bearing zone 2*b* (upstream and downstream in the drilling fluid flow direction in the annulus as represented by arrow 23), both of which are cylindrical in shape and along which the drill rod is covered in a respective anti-wear layers 22'*a* and 22'*b*.

The bearing zones 2*a* and 2*b* of the drill rod are spaced apart from each other by a central portion of the drill rod that is substantially cylindrical in shape and that extends over a length that is generally longer than the lengths of the bearing zones.

By way of comparison, the central portion of a drill rod 1 of the invention as shown in FIG. 7B has a bearing zone 2 in which the upstream and downstream bearing segments 7*a* and 7*b* are cylindrical in shape and can be substantially analogous to the bearing zones 2*a* and 2*b* of a prior art drill rod, but are situated closer together in the axial direction 6 of the drill rod, being spaced apart by an intermediate zone 8 of the bearing zone, said intermediate zone having a profile that serves to activate the drilling fluid flow and produce a hydrodynamic bearing effect at the bearing portions 7*a* and 7*b*.

The activation zone 8 may advantageously be of a length in the axial direction 6 of the drill rod that is practically equal to the length of the bearing segments 7*a* and 7*b*.

The disposition of the invention as shown in FIG. 7B serves in particular to reduce considerably the friction between the drill rod and the wall of the borehole at the bearing segments 7*a* and 7*b*, and also serves to activate the entrainment of drilling cuttings.

Figure 8A:
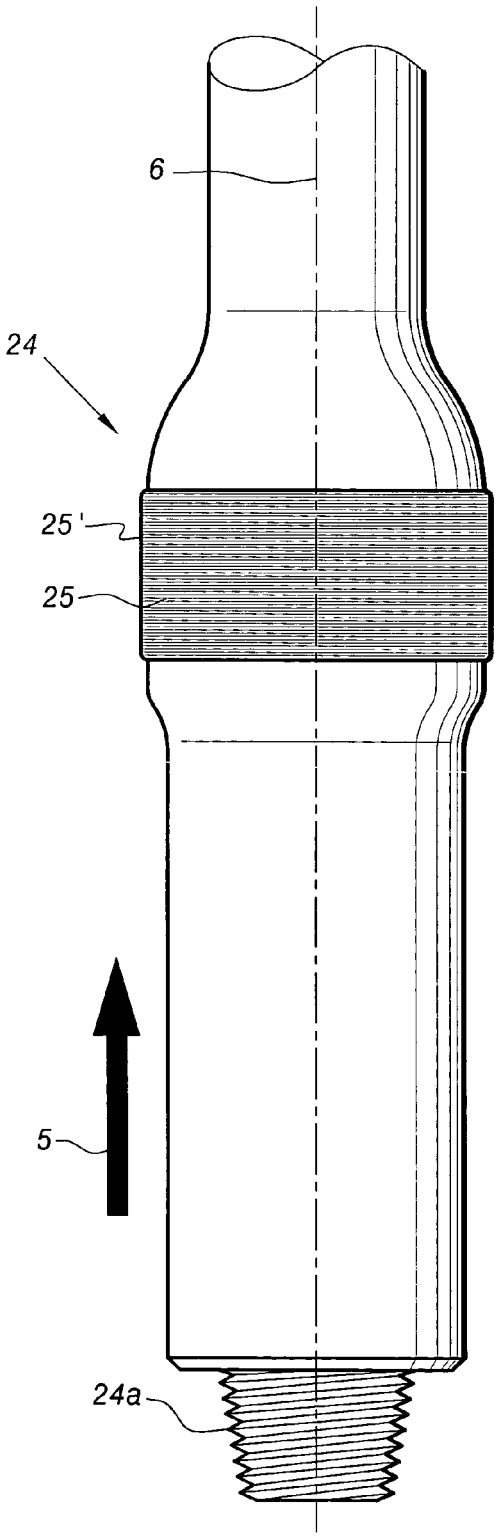
FIGS. 8A and 8B are comparative side elevation views of a tool joint made respectively in accordance with the prior art and in accordance with the invention.
Figure 8B:
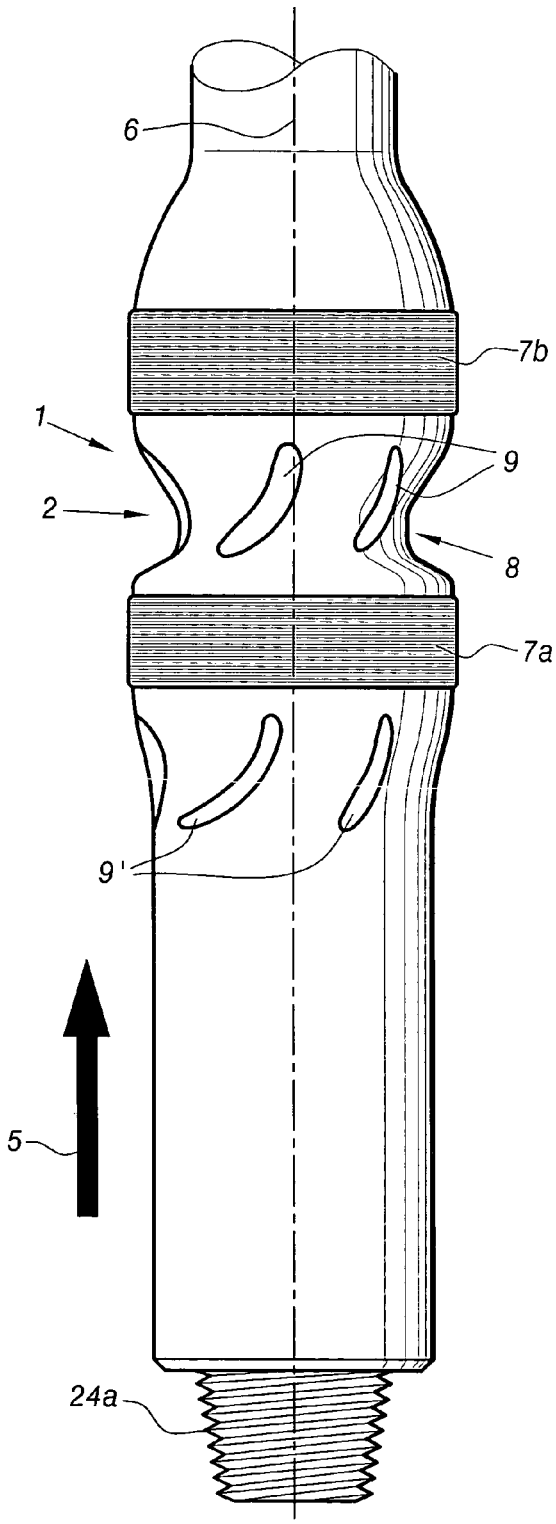

FIGS. 8A and 8B show one end of a drill string element constituting a tool joint having a bearing zone protected against wear and made respectively in accordance with the prior art (FIG. 8A) and in accordance with the invention (FIG. 8B).

The tool joint 24 of the prior art has a threaded end junction portion 24*a* and a central bearing portion 25 of a diameter that constitutes the maximum diameter of the tool joint. The bearing portion 25 may advantageously be covered in a layer of anti-wear material 25'. The tool joint does not come into contact with the wall of the borehole other than in the zone 25, such that the end junction portions of the tool joint are well protected against wear by friction against the borehole wall.

FIG. 8B shows a tool joint 1 of the invention beside the prior art tool joint 24, by way of comparison.

The tool joint 1 of the invention may be made in a manner substantially analogous to the device shown in FIG. 2 as described above. In the intermediate activation zone 8 between two bearing segments 7*a* and 7*b* of the bearing zone 2, the tool joint may include grooves 9 extending helically and serving to improve activation of the drilling fluid. The tool joint 1 may also have helical grooves 9' analogous to the grooves 9 in a zone situated upstream from the upstream bearing segment 7*a* of the bearing zone 2.

The prior art tool joint shown in FIG. 8A and the tool joint of the invention shown in FIG. 8B present bearing portions of substantially equal lengths, with the sum of the lengths of the bearing segments 7*a* and 7*b* being substantially equal to the axial length of the bearing portion 25 of the prior art tool joint 24. As a result, the bearing zone 2 of the tool joint 1 of the invention, which includes an intermediate activation zone 8, presents an overall axial length that is greater than the length of the bearing zone of the prior art tool joint 24. Contact between the tool joint of the invention and the borehole wall is improved, and because the drilling fluid is activated, friction is decreased. The bearing and protection effect obtained by the tool joint is thus significantly improved.

In general, the axial length of the bearing segments of drill string elements of the invention is shorter than or equal to 80 mm regardless of the nominal diameter of the drill string elements.

As mentioned above, the outside surface of the activation zone may present a meridian constituted by straight lines or by curved lines connected together in a central portion of the activation zone.

Figure 9A:
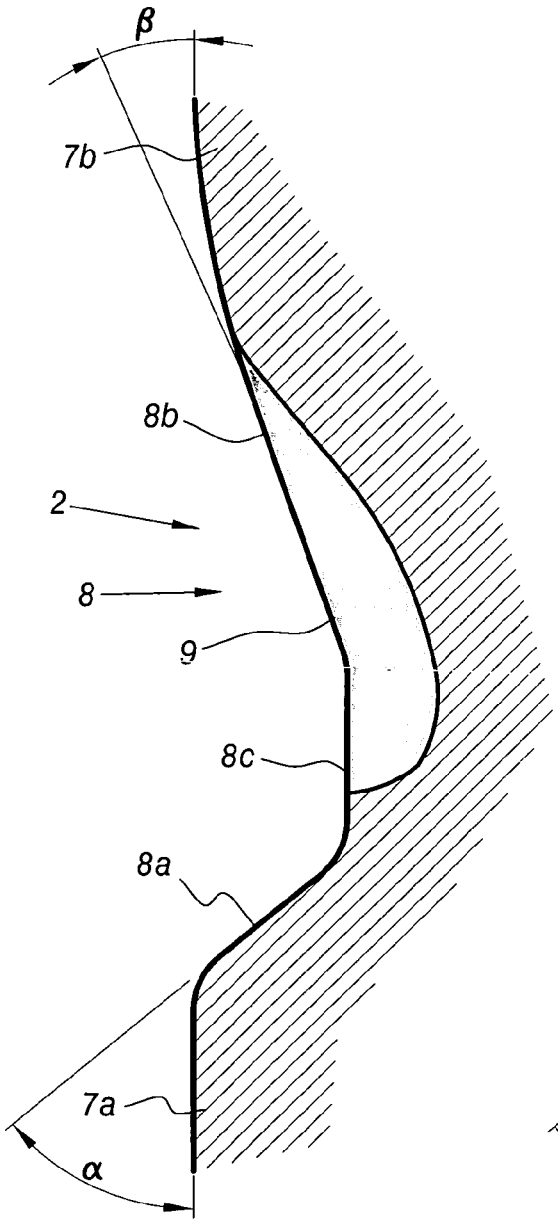
FIGS. 9A and 9B are axial section views of intermediate activation zones interspersed between two bearing zone portions of a drill rod element in accordance with the invention.

FIG. 9A shows the meridian profile of the outside surface of an activation zone 8 having rectilinear portions, a first portion 8*a* of the meridian adjacent to the upstream bearing segment 7*a* being rectilinear and making an angle a relative to the axial direction 6 of the drill string element on which the activation zone 8 is machined, a second portion 8*b* adjacent to the downstream bearing segment 7*b* of the bearing zone 2 of the drill string element being rectilinear and making an angle β with the axial direction of the drill string element, the two portions 8*a* and 8*b* of the meridian being connected together via a meridian portion 8*c* that extends substantially parallel to the axis and that corresponds to a minimum-diameter zone of the outside surface of the bearing zone 2 of the drill string element.

As mentioned above, the angle α is preferably substantially greater than the angle β so as to obtain an optimum turbulence and deflection effect on the drilling fluid in the activation zone 8.

In addition, helically-shaped grooves 9 can be machined in the outside surface of the activation zone defined by the meridian portions 8*a*, 8*b*, and 8*c*.

Figure 9B:
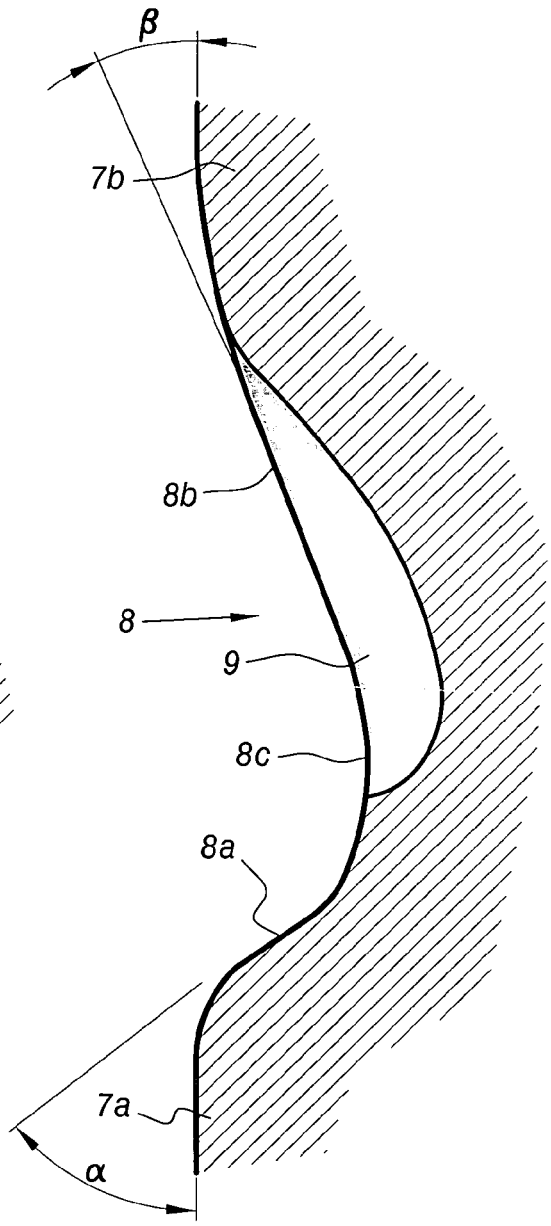

FIG. 9B shows a bearing zone 2 of a drill string element of the invention including an activation zone whose outside surface presents a curved meridian comprising a first meridian portion 8*a* adjacent to the upstream bearing segment 7*a* of a shape that is slightly curved or rectilinear, and a portion 8*b* adjacent to the downstream bearing segment 7*b* of the bearing zone 2 of the drill string element which may be slightly curved or substantially rectilinear, the portions 8*a* and 8*b* of the meridian making respective general angles α and β with the axial direction of the drill string element. When the meridian portions 8*a* and 8*b* are curved, the angles α and β are determined from the tangent to a middle point of the curved meridian portion 8*a* or 8*b*. The meridian of the outside surface of the activation zone 8 includes a central portion 8*b* of curved shape where the diameter of the outside surface of the bearing zone 2 of the drill string element is a minimum.

The upstream and downstream meridian portions 8*a* and 8*b* are connected to the central meridian portion 8*c* and to the meridians of the bearing segments 7*a* and 7*b* via curved lines. As a result, the profile of the outside surface of the activation zone 8 does not include any sharp angles.

With the profile as shown in FIG. 9A, grooves 9 extending helically may be machined in the shaped outside surface of the activation zone 8 so as to have a section with an undercut portion in order to produce a scoop effect. In all cases, the activation zone 8 enables drilling fluid flow to be obtained that provides a hydrodynamic bearing effect at the upstream and downstream cylindrical bearing segments 7*a* and 7*b* of the bearing zone.

Drill string elements of the invention may present bearing zones having more than two bearing segments, with any two successive bearing segments in the axial direction of the drill string element being spaced apart by an activation zone that generally presents a meridian of asymmetrical profile.

The respective lengths of the bearing segments and of the adjacent activation zones of the bearing zones may be adapted as a function of the desired bearing and friction limitation.

The outside surfaces of the activation zones may be of shapes different from those described, but in all circumstances they must have two meridian portions sloping towards the axis of the drill string element in opposite directions and they must be connected to a central portion of the outside surface that presents a minimum diameter.

The drill string element of the invention may be constituted by any element such as a drill rod, a drill collar, a tool joint, or any other element having at least one bearing zone that may be included in a drill string.

What is claimed is:

1. A drill string element for drilling a borehole with drilling fluid flowing in an annulus between the drill string and a wall of the borehole in a flow direction along a longitudinal axis of the drill string going from a bottom end of the borehole towards the surface, the drill string element including at least one bearing zone for bearing against the wall of the borehole during drilling, wherein the bearing zone of the drill string element comprises at least one bearing segment whose outside surface is cylindrical and of substantially constant outside diameter greater than the diameter of any other portion of the drill string element, together with a guide zone of convex curved shape tangential to the bearing zone.

2. A drill string element according to claim 1, wherein upstream from at least one bearing segment, the drill string element presents a drilling fluid guide zone tangential to the bearing segment whose convex outside surface presents a continuous curved meridian, in particular a circular meridian, having a radius of curvature that is not less than one-third the diameter of the bearing segments.

3. An element according to claim 1, wherein upstream and downstream from the bearing zone the outside surface of the drill string element comprises portions of generally convex shape having a radius of curvature not less than one-third the diameter of at least one bearing segment.

4. An element according to claim 3, wherein at least one of the convex surface portions of the outside surface of the drill string element disposed upstream and downstream from the bearing zone includes grooves formed therein following helical dispositions around the axis of the drill string element.

5. An element according to claim 1, wherein at least one segment of the bearing zone is of a length that is less than or equal to 80 mm.

6. A drill string element according to claim 1, further comprising, in a disposition adjacent to the bearing segment, a drilling fluid activation zone of circular symmetry about the axis of the drill string, having an outside surface presenting a meridian with a first portion and a second portion situated downstream from the first portion in the drilling fluid flow direction, said portions being generally inclined in opposite directions relative to the axial direction of the drill string, sloping towards the axis of the drill string and connected together by a meridian line of a minimum-diameter central section of the bearing zone.

7. A drill string element according to claim 6, wherein the bearing zone of the drill string element has a first bearing zone and a second bearing zone disposed downstream from the first bearing zone in the direction of drilling fluid flow in the annulus, and that the drilling fluid activation zone extends axially between the first bearing segment and the second bearing segment.

8. A drill string element according to claim 6, wherein the first portion of the meridian of the activation zone of the bearing zone presents a general direction making a first angle $\alpha$ with the axial direction of the drill string that is less than a second angle $\beta$ made between the general direction of the second portion of the meridian of the outside surface of the activation zone and the axial direction of the drill string.

9. A drill string element according to claim 6, wherein the drilling fluid guide zone comprises a portion downstream from the activation zone having as its meridian the second portion of the meridian of the activation zone.

10. A drill string element according to claim 6, wherein the outside surface of the drill string element has grooves machined therein, in the activation zone of the bearing zone in dispositions that are generally helical about the axis of the drill string element.

11. An element according to claim 6, wherein the outside surface of the central section of minimum diameter of the bearing zone includes cavities distributed around its periphery, preferably being machined to be undercut, so as to obtain a scoop effect for stirring the drilling fluid in the activation zone during rotation of the drill string.

12. A drill string element according to claim 1, wherein the outside surface of at least one segment of the bearing zone is covered by a covering of hardness that is much greater than the hardness of the base metal of the drill string element, the covering extending between first and second lines of contact between the outside surface of the bearing segment and one of the guide zone and of a portion of the activation zone tangential to the segment.

13. A drill string element according to claim 6, constituting a drill rod having upstream and downstream end coupling portions, and between the coupling portions at least one bearing zone having at least one bearing segment and at least a guide zone and an activation zone adjacent to the bearing segment.

14. A drill string element according to claim 13, comprising first and second bearing zones in dispositions that are adjacent respectively to its upstream end junction portion and its downstream end junction portion and at least one bearing zone between the bearing zones respectively adjacent to the upstream end junction portion and to the downstream end junction portion, spaced apart in the axial direction of the drill rod away from the end junction portions.

15. A drill string element according to claim 13, including, in a disposition adjacent to and upstream from the bearing zone, a cleaning zone in which the outside surface of the drill string element has cavities or grooves, preferably in helical dispositions, and including undercut portions.

16. A drill string element according to claim 15, including, in its outside surface, a deflection surface at one end of the cleaning zone adjacent to the bearing zone of the drill rod.

17. A drill string element according to claim 13, including, downstream from the bearing zone, a groove about the axis of the drill string element and including a deflection surface inclined relative to the axis of the drill string element towards the wall of the borehole, at an axial end of the groove remote from an adjacent end of the bearing zone.

18. A drill string element according to claim 6, having upstream and downstream end junction portions or tool joints, wherein each tool joint includes at least one bearing zone having at least one bearing segment and at least a guide zone and a drilling fluid stirring zone adjacent to the bearing segment.

19. An element according to claim 18, including helical grooves machined in the outside surface of the tool joint, preferably in helical dispositions with undercut portions, in at least one of the intermediate activation zone of the bearing zone and a zone adjacent to the bearing zone and upstream from the bearing zone.

20. A drill string element according to claim 1, wherein the guide zone presents a meridian having a radius of curvature at all points that is not less than one-third the diameter of the bearing segment, the meridian extending axially in a disposition adjacent to the bearing segment of cylindrical surface.

* * * * *